United States Patent [19]

Ito et al.

[11] 4,301,359

[45] Nov. 17, 1981

[54] HEAT ROLLER TYPE FIXING APPARATUS FOR ELECTROPHOTOGRAPHIC COPYING MACHINE

[75] Inventors: Takashi Ito, Hachioji; Nin-ichi Kamogawa, Tokyo, both of Japan

[73] Assignee: Konishiroku Photo Industry Co., Ltd., Tokyo, Japan

[21] Appl. No.: 122,465

[22] Filed: Feb. 19, 1980

[30] Foreign Application Priority Data

Feb. 24, 1979 [JP] Japan ..... 54-21099

[51] Int. Cl.[3] ..... G03G 5/00; H05B 1/02

[52] U.S. Cl. ..... 219/469; 219/216; 355/3 FU

[58] Field of Search ..... 219/469–471, 219/216; 355/3 FU; 432/60, 228

[56] References Cited

U.S. PATENT DOCUMENTS

| | | | |
|---|---|---|---|
| 3,369,106 | 2/1968 | Troll | 219/469 |
| 3,461,275 | 8/1969 | Poole | 219/469 |
| 3,725,639 | 4/1973 | Seil et al. | 219/469 |
| 4,186,606 | 2/1980 | Tarumi et al. | 73/351 |

FOREIGN PATENT DOCUMENTS

| | | | |
|---|---|---|---|
| 1377375 | 12/1974 | United Kingdom | 219/471 |

*Primary Examiner*—Gene Z. Rubinson
*Assistant Examiner*—Bernard Roskoski
*Attorney, Agent, or Firm*—James E. Nilles

[57] ABSTRACT

A heat roller type fixing apparatus for electrophotographic copying machine comprising a heat roller containing a heating element, a press roller which presses against and rotates with the heat roller, temperature sensing elements for detecting the surface temperature of the heat roller, and a control circuit which controls the conduction of the heating element in response to the output from the temperature sensing elements. The heating element having a heating characteristic such that, at the initial stage of heating, the surface of the heat roller exhibits a low temperature area at its longitudinally central portion and highest temperature areas on both sides of the low temperature area. The temperature sensing elements being set at positions almost midway between the low temperature area and the highest temperature areas of the heat roller surface.

3 Claims, 5 Drawing Figures

HEAT ROLLER TYPE FIXING APPARATUS FOR ELECTROPHOTOGRAPHIC COPYING MACHINE

BACKGROUND OF THE INVENTION

1. Field of the Invention

This invention relates to a heat roller type fixing apparatus for electrophotographic copying machines, and more particularly to a heat roller type fixing apparatus in which the surface temperature of the heat roller is controlled in accordance with the copying operation.

2. Description of the Prior Art

The heat roller type fixing apparatus consists of a hollow heat roller (referred to as heat roller, merely hereinafter) containing a heating lamp such as a halogen lamp or infrared ray lamp in a hollow space, and a press roller which presses against and rotates with the heat roller, whereby a transfer paper with a toner image which has undergone a transfer process is fed between these rollers to melt and fix the toner image by heat. This type of fixing device is superior as compared with other type in that even when the paper becomes cloggy no fires will occur. It has, however, the disadvantage that the warming-up time (a time it takes for the roller surface to reach a temperature at which the fixing can be done, after the fixing apparatus has been switched on) is long. The warming-up time can be shortened by increasing the capacity of the heating lamp or reducing the heat capacity of the heat roller. In this case, an overshoot (a phenomenon in which the surface temperature of the heat roller reaches its peak beyond the setting temperature) becomes greater. On the other hand, too low a surface temperature of the heat roller will result in an underfixing (a phenomenon in which the toner image does not adhere to a substrate such as plain paper sufficiently and easily comes off it) and too high a surface temperature will produce an offset phenomenon (in which a part of the toner image on the substrate adheres to the heat roller and then sticks to other part of the substrate after one rotation). Thus, accurate control of the surface temperature of the heat roller is very important.

In the ordinary heat roller type fixing apparatus, which have bearings at the ends of the heat roller and also a gear or sprocket at one end of the roller that meshes with the roller driving mechanism, a large amount of heat is radiated through these components resulting in a temperature distribution on the surface of the heat roller such that the longitudinal end portions of the roller surface are lower in temperature than the central portion. Such uneven temperature distribution in the axial direction will cause defective fixing such as underfixing and offset phenomena. To solve this problem a proposal has been made of a heating lamp which has a heat intensity characteristic such that the heat generated at its end portions is greater than that at the central portion. This kind of heating lamp produces a temperature distribution on the heat roller surface which has the highest temperature area between the roller ends and the central portion, due to a great heat radiation effect at both ends, and the low temperature area at the central portion of the roller surface.

In the fixing apparatus utilizing a heat roller with such a surface temperature distribution, it is a known practice to set temperature sensing elements close to the surface of the roller to control the roller surface temperature. In controlling the roller surface temperature, selection of the axial position on the roller surface at which the temperature sensing element is set constitutes an important problem.

It has been proposed to situate the temperature sensing element at the central portion of the roller surface in the conventional fixing devices. In this method, however, when the temperature of the central portion of the roller surface reaches the setting temperature, the temperatures at the areas between the central portion and the ends have far exceeded the setting temperature, causing the so-called overshoot phenomenon. To prevent the overshoot in this method, the heating lamp must be turned off at the temperature lower than the setting temperature and, in the steady state condition, the conduction of the heating lamp must be controlled at the setting temperature. This means that duplicate control circuit must be provided. This tendency becomes greater with increased capacity of the heating lamp.

In addition to these drawbacks the conventional temperature contol method also has the following disadvantage: since the temperature of the roller surface is maintained at one and the same value regardless of whether the device is copying or standing by, unnecessarily large amount of heat is generated during the stand-by, producing adverse effects upon the components of the roller such as deterioration of the quality of lubricating oil in the bearings and of the resin covering the surface of the roller. This is one of the factors limiting the life of the fixing apparatus.

SUMMARY OF THE INVENTION

This invention has been accomplished to overcome the aforementioned drawbacks by properly selecting the position of the temperature sensing element. To state more concretely, the heat roller incorporating a heating lamp whose heat intensity characteristic is determined in consideration of the heat radiation effect at ends of the heat roller has a surface temperature distribution which has a low temperature area at the longitudinally central portion of the roller surface and highest temperature areas on both sides of the low temperature area. Taking this fact into consideration, the temperature sensing elements are arranged close to the roller surface at intermediate positions between the highest temperature areas and the low temperature area so as to maintain the surface temperature of the heat roller during the stand-by at near the setting temperature and, during the copying operation, at a temperature somewhat higher but not so high that the offset phenomenon results. With this invention, it is possible to improve the fixing property of the apparatus without causing the overshoot and reduce the heat effect on the components of the heat roller thereby extending the life of the fixing apparatus.

BRIEF DESCRIPTION OF THE DRAWINGS

FIG. 4 shows comparison between the surface temperature distribution characteristics of the heat roller immediately after the apparatus has been switched on.

DETAILED DESCRIPTION OF THE PREFERRED EMBODIMENT

Figure 1:
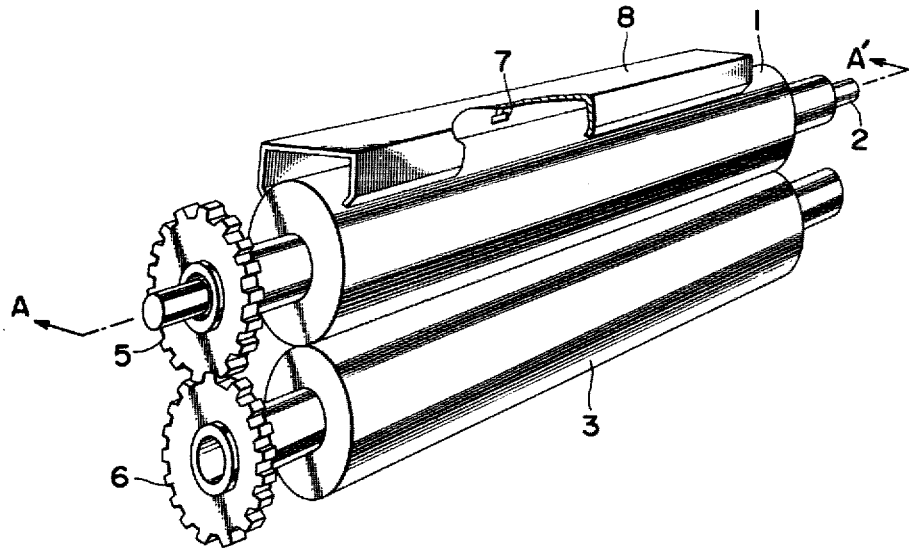
FIG. 1 of the accompanying drawings is a perspective view of a heat roller type fixing apparatus.
Figure 2:
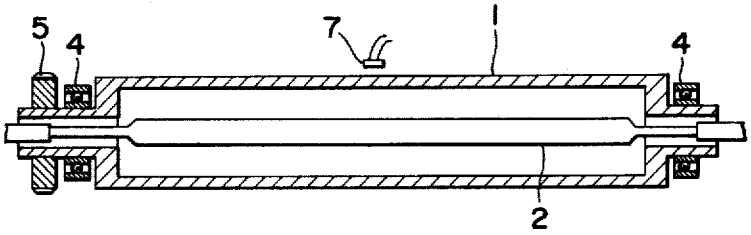
FIG. 2 is a cross-sectional view of the heat roller type fixing apparatus taken along the line A—A' of FIG. 1.

FIGS. 1 and 2 show a typical construction of the heat roller type fixing apparatus. Reference numeral 1 represents a heat roller which is usually an aluminum roller with wall thickness of 4–5 mm, coated on its surface with tetrafluoroethylene film 40–80μ thick. Denoted 2 is an infrared ray lamp disposed in the heat roller 1. For the reason already described, the lamp is so designed that it produces greater heat near its ends than at the longitudinally central portion. 3 indicates a press roller to clamp the copying paper between it and the heat roller 1 to feed the paper. The press roller 3 is usually made of silicone rubber or coated with silicone rubber. 4 is bearings to rotatably support the heat roller 1. 5 and 6 signify gears to rotate the heat roller 1 and the press roller 3, and the gear 5 is connected with a driving mechanism by a suitable means (not shown). 7 represents a temperature sensing element which is a heat sensing resistor such as a Chromel-Alumel thermocouple or a thermistor and senses the surface temperature of the heat roller 1 and produces corresponding electric outputs. In this embodiment, the temperature sensing element 7 is mounted closely to the surface of the heat roller 1. It may be so arranged that the temperature sensing element 7 is in contact with the heat roller surface at the position C or E as will be described hereinafter. A cover 8 protects the temperature sensing element 7 from the direct blow of wind. A control circuit, which compares the output from the temperature sensing element 7 with the reference value corresponding to the setting surface temperature of the heat roller and thereby controls the conduction of the infrared ray lamp 2, is very popular and widely known; hence no particular explanation will be made here.

Figure 3:
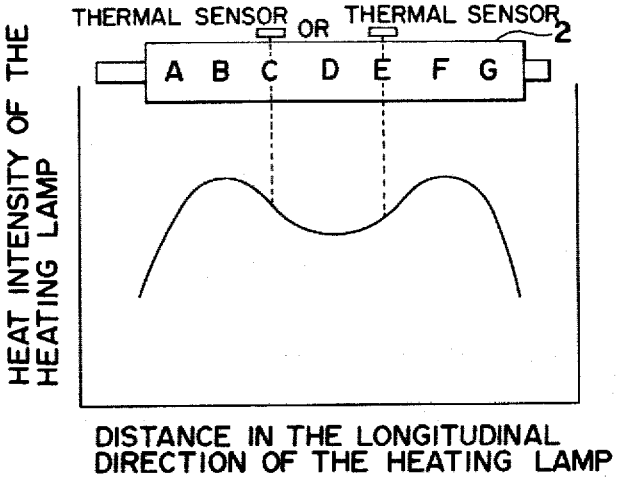
FIG. 3 shows a heat intensity distribution characteristic of the heating lamp.

FIG. 3 shows the heat intensity distribution of the heating lamp. The lamp is so designed that more heat is generated at its ends than at the central portion in consideration of the heat radiation effect at the ends of the heat roller.

Figure 4:
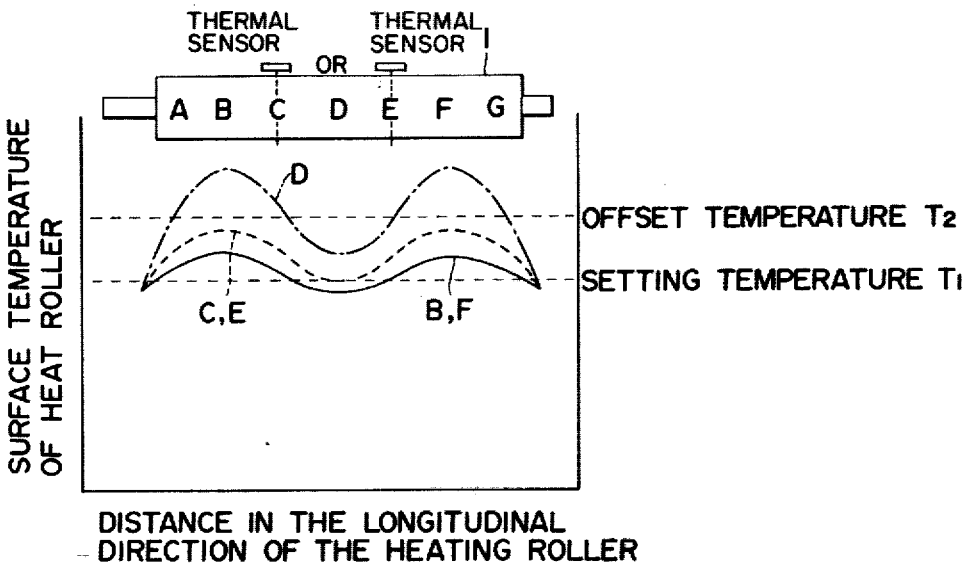

The heating lamp 2 is divided into several areas to which symbols A, B, C, D, E, F and G are allocated, as shown in FIG. 3, and the same symbols are given to the corresponding positions on the heat roller surface, as shown in FIG. 4. In many experiments, when the temperature sensing elements 7 are set close to the positions A, B, . . . , G of the surface of the heat roller 1 to determine the suitability of each position for controlling the temperature of the roller 1 in the fixing apparatus with the construction shown in FIGS. 1 and 2, it has been found that the positions A and G are not suitable locations at which to place the temperature sensing elements 7 since these positions near the end of the roller are susceptible to outer influences such as wind and ambient temperatures. FIG. 4 illustrates the temperature distributions on the roller surface as controlled by the temperature sensing elements 7 set at the positions B, C, D, E and F, immediately after the heating lamp has been turned on or in rising up time. As can be seen from FIG. 4, when the temperature control is performed by the temperature sensing elements 7 set at the positions B and F and at the positions C and E, the temperature varies moderately over the whole surface within the range between the setting temperature T1 and the offset temperature T2. However, with the temperature sensing element set at the position D, the maximum temperature far exceeds the offset temperature T2.

Figure 5:
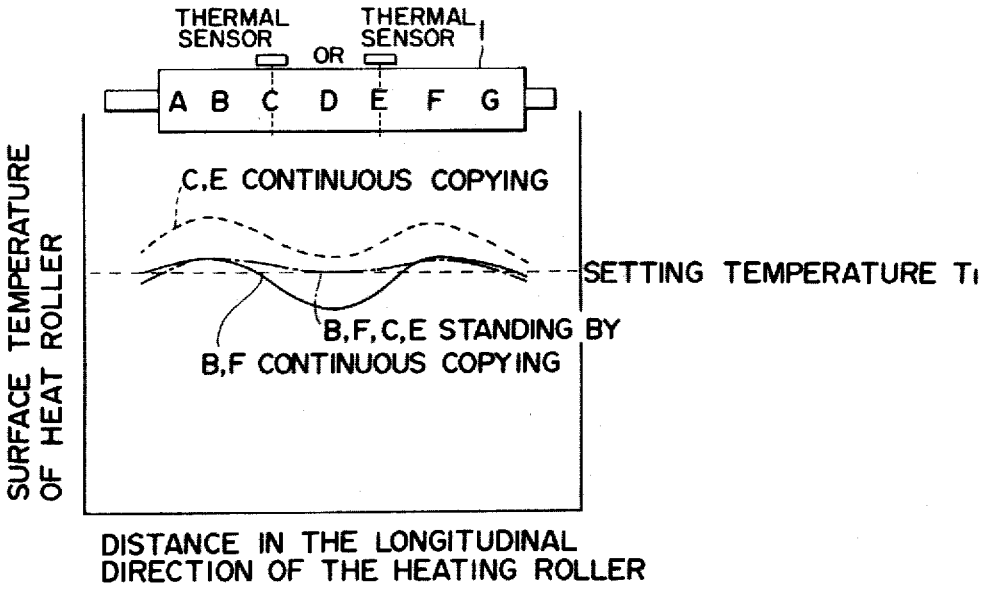
FIG. 5 shows comparison between the controlled surface temperatures of the heat roller.

Now, if the transfer paper is supplied to the fixing apparatus of the above temperature condition, a portion of heat of the heat roller 1 is absorbed by the transfer paper so that the surface temperature of the roller 1 becomes low over the whole surface. In this case, if the temperature sensing elements 7 are disposed at the positions B and F, the heating lamp, after having been turned on by the signal from the temperature sensing elements, will immediately heat the roller surface under the temperature sensing elements to the setting temperature T1 and the lamp will then be turned off. As a result, the surface temperature of the heat roller is maintained at almost the setting temperature T1 over the substantial portion of the roller surface. When the temperature sensing elements 7 are set to the positions C and E the heating lamp remains turned on for a longer period of time than when the sensors are set to the positions B and F, so that surface temperature of the roller becomes higher than the setting temperature T1 over the whole surface and shows better characteristic. Under the steady state condition reached after the warmingup, the surface temperature of the heat roller is stable, as shown by the dot-and-dash line of FIG. 5 (a condition ready for copying). Therefore, if the temperature sensing elements are located at the positions C and E, the surface temperature of the heat roller remains close to the setting temperature T1 while the device is in a ready-for-copying condition, and is kept somewhat higher during the continuous copying and fixing processes. This ensures satisfactory fixing. On the one hand, since the overshoot that occurs when the surface temperature reaches this range is small, no offset phenomenon results. Thus, during the fixing process the heat roll surface is kept at a temperature higher than the setting temperature T1 ensuring satisfactory fixing, and in the ready-for-copying condition the surface temperature is maintained at somewhat lower temperature (but not below the setting temperature T1) thereby reducing the adverse effect of heat on the bearing of the heat roller and especially the lubricating oil. The ready-for-copying condition occupies a great proportion of the total operating time of the copying machine. Therefore, reducing the adverse effect of heat upon the constitutional elements of the heat roller will greatly contribute to a longer life of the heat roller.

What is claimed is:

1. A heat roller type fixing apparatus for electrophotographic copying machine comprising: a heat roller containing a heating element, the heating element having a heating characteristic such that, when said heating element is energized, the surface of the heat roller exhibits a minimum low temperature area at its longitudinally central portion and a maximum high temperature areas on both sides of the minimum low temperature area; and spaced longitudinally therefrom a press roller which presses against and rotates with the heat roller; a temperature sensing element for detecting the surface temperature of the heat roller; a control circuit which controls the operation of the heating-element in response to the output from the temperature sensing element, the improvement comprising that said temperature sensing element is located midway between said minimum low temperature area and one of said maximum high temperature areas.

2. A heat roller type fixing apparatus as claimed in claim 1, wherein the temperature sensing element is a thermocouple.

3. A heat roller type fixing apparatus as claimed in claim 1, wherein the heating element is an infrared ray lamp which exhibits a higher density of ray at its both axial end portions.

* * * * *